US005387308A

United States Patent [19]

Heavrin

[11] Patent Number: 5,387,308

[45] Date of Patent: Feb. 7, 1995

[54] CARPET STRIPPER

[76] Inventor: Patrick Heavrin, 1575 Marionville Dr., Mississauga, Ontario, Canada, L5E 2Y4

[21] Appl. No.: 184,531

[22] Filed: Jan. 21, 1994

[30] Foreign Application Priority Data

Jan. 21, 1993 [CA] Canada ..... 2087774-0

[51] Int. Cl.[6] ..... B32B 35/00

[52] U.S. Cl. ..... 156/584; 254/200; 294/8.6; 294/103.1; 269/54.5

[58] Field of Search ..... 156/584; 254/199, 200, 254/209, 210, 211, 262; 294/8.6, 103.1, 902; 269/53, 54.5; 16/5

[56] References Cited

U.S. PATENT DOCUMENTS

| | | | |
|---|---|---|---|
| 126,818 | 5/1872 | Lindsay | 294/8.6 |
| 549,341 | 11/1895 | Veigel | 294/8.6 |
| 1,971,218 | 8/1934 | Hooble | 254/211 |
| 2,454,878 | 11/1948 | Marler | 294/103.1 X |
| 2,528,229 | 10/1950 | Kelly | 294/902 X |
| 2,608,793 | 9/1952 | Gant | 254/209 |
| 4,533,118 | 8/1985 | Thomas et al. | 254/202 |
| 4,560,146 | 12/1985 | Thomas et al. | 156/344 X |
| 4,906,323 | 3/1990 | Thomas | 156/344 X |

*Primary Examiner*—Mark A. Osele
*Attorney, Agent, or Firm*—Barrigar & Moss

[57] ABSTRACT

A method and apparatus are disclosed for the removal of carpet adhesively attached to a floor. The carpet is cut into strips of predetermined width and an end of each strip is pulled up. A clamp is provided to grip the pulled-up strip end. The clamp has an elongate lower jaw with a plurality of upright longitudinally spaced-apart spikes extending therefrom. An inverted, U-shaped upper jaw is hingeably mounted to swing down over the spikes to impale the carpet thereon, and a locking ring locks the upper jaw in place. An elongate handle is rigidly attached to the jaws to rotate and pull the jaws, thus pulling up the carpet.

10 Claims, 3 Drawing Sheets

CARPET STRIPPER

BACKGROUND OF THE INVENTION

This invention relates to the removal of carpet adhesively attached to a floor, and in particular, to tools for gripping and pulling up such adhesively attached carpet.

FIELD OF THE INVENTION

In office buildings and other high traffic areas, where carpet is used as a floor covering, it is common to attach the carpet to the floor using adhesives. When the carpet wears out and must be replaced, the existing adhesively attached carpet must be removed. In the past, the method used most commonly to remove this old carpet was simply to peel an edge of the carpet back and grasp the carpet by hand and pull it up. Sometimes ordinary pliers or locking pliers are used to help grip the carpet, but if the carpet is very old or worn out, this often just tears chunks or pieces out of a carpet. Soaking the carpet with water or solvents may make the task a little easier depending upon the adhesive, but this results in a very messy situation. In fact, cleaning up the leftover mess in some cases is worse than tearing up the carpet bit-by-bit. Further, solvents are very dangerous due to the risk of explosion or fire, not to mention the environmental or health hazard involved in using solvents in close quarters or indoors, such as the inside of an office building.

Attempts have been made to produce machines to remove or strip adhesively attached carpet. Examples of these are shown in U.S. Pat. Nos. 4,533,118 and 4,560,146 issued to Philip D. Thomas et al. The apparatus shown in these patents uses a winch to provide the pulling force and a toothed jaw to grip the carpet. An anchoring device is necessary to hold the winch in place. The major difficulty with these devices, however, is that they require a large open space to be used. Also, they are cumbersome and difficult to set up. For example, it would be very difficult to use these devices where it is necessary to work around furniture.

A much simpler carpet stripping device is shown in U.S. Pat. No. 4,906,323 issued to Philip D. Thomas. This patent shows a toothed gripping means for gripping a carpet, a harness to go around a user's hips and a flexible strap to connect the harness to the gripping means. A difficulty with this type of device, however, is that it is only good for carpet that is in reasonably good condition and again, a lot of open space is required to use the device. If the carpet is in poor condition, the clamp would just pull a chunk or piece out of the carpet.

The present invention provides an elongate gripping assembly for spreading out the pulling force on the carpet and an elongate, rigid handle rigidly and transversely attached to the gripping assembly, so that the gripping assembly can be rotated and pulled to control the lifting forces on the carpet being removed.

According to one aspect of the invention, there is provided a carpet stripper comprising an elongate, rigid handle having a distal end portion. A gripping assembly is rigidly attached to the distal end portion and extends transversely on either side of the handle. The gripping assembly has an elongate lower jaw including a plurality of longitudinally spaced-apart spikes extending upwardly therefrom. An inverted, U-shaped upper jaw is hingeably attached to a first end of the lower jaw to swing down over the spikes, and a releasable locking member is connected between a second opposed end of the lower jaw and the upper jaw to lock the upper jaw in position covering the spikes.

According to another aspect of the invention, there is provided a method of removing carpet adhesively attached to a floor. The method comprises the steps of cutting the carpet along spaced-apart parallel lines to form longitudinal strips of predetermined width of adhesively attached carpet. An initial peripheral edge portion of each strip of carpet is gripped and pulled up. An elongate gripping assembly is provided having upper and lower jaws. The pulled-up carpet edge portion is clamped between the jaws and the jaws are pulled in a direction transversely thereto and back over the adhesively attached carpet strip. The jaws are also rotated from side-to-side as they are pulled.

BRIEF DESCRIPTION OF THE DRAWINGS

Preferred embodiments of the invention will now be described, by way of example, with reference to the accompanying drawings, in which.

DESCRIPTION OF THE PREFERRED EMBODIMENTS

Figure 1:
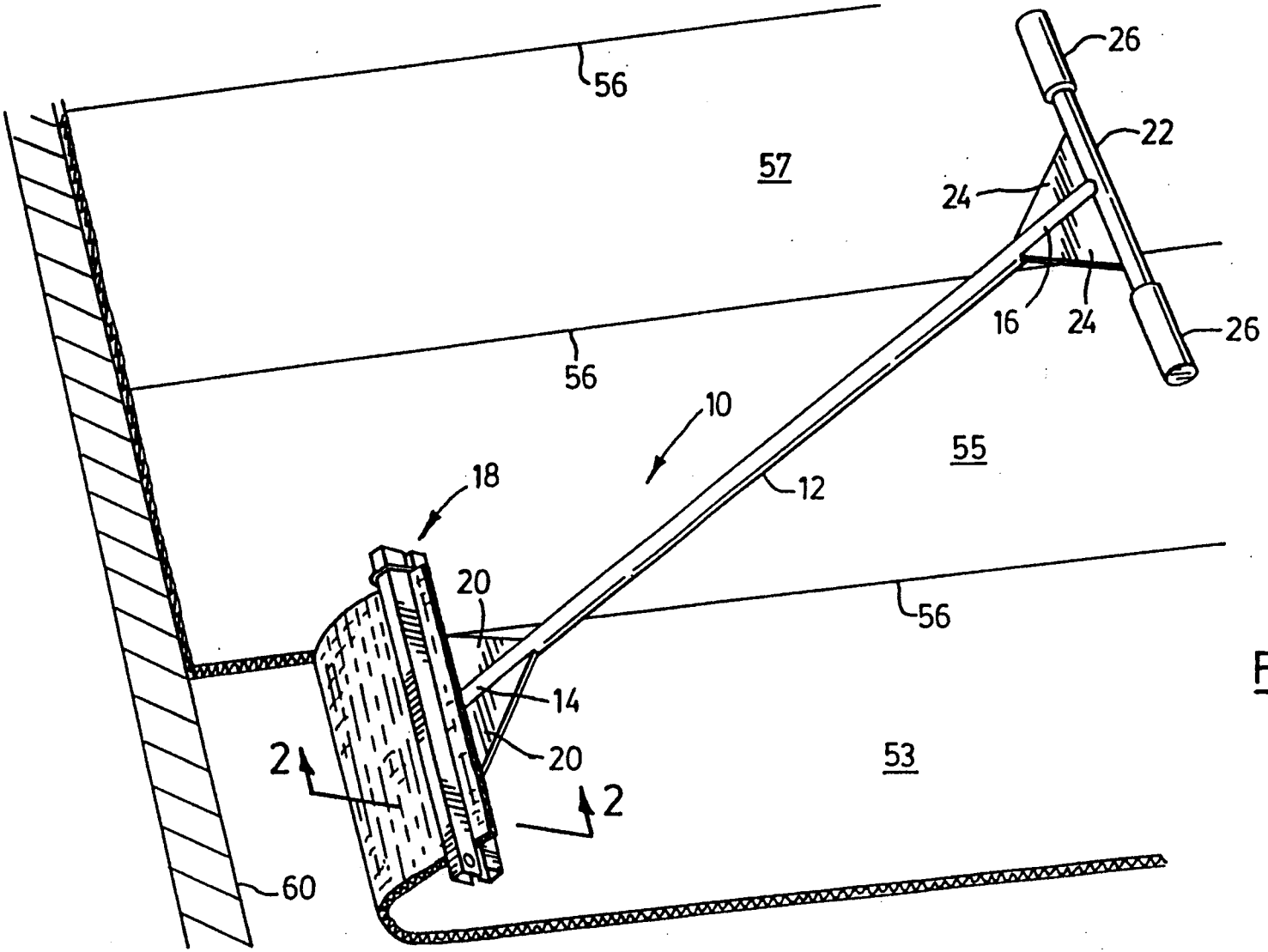
FIG. 1 is a perspective view of a preferred embodiment of a carpet stripper shown pulling up a strip of carpet adhesively attached to a floor.

Referring to the drawings, a preferred embodiment of a carpet stripper according to the present invention is generally represented in FIG. 1 by reference numeral 10.

Carpet stripper 10 has an elongate, rigid, tubular handle 12, which is preferably about 1 meter in length and about 2 to 3 centimeters in outside diameter, but could be up to 2 meters in length, if desired. Handle 12 has a lower or first distal end portion 14 and a second or upper distal end portion 16. Lower distal end portion 14 is rigidly connected to a transverse gripping assembly 18, so that gripping assembly 18 extends transversely on either side of handle 12. Gussets 20 are used to reinforce the rigid connection between handle 12 and gripping assembly 18. Upper distal end portion 16 has a transverse handle bar 22 rigidly attached thereto extending on either side of handle 12. Gussets 24 reinforce the connection between the handle 12 and handle bar 22. Hand grips 26 are mounted on the distal ends of handle bar 22 to make it easier for a user to obtain a firm grip on handle bar 22.

Handle bar 22 preferably is made of the same tubular stock as handle 12 and is typically about 50 centimeters in length. Hand grips 26 can be made from any suitable resilient material. Handle grips 26 could be eliminated, of course, or could be replaced with a suitable adhesive tape or the means to improve other grip on handle bar 22.

Figure 2:
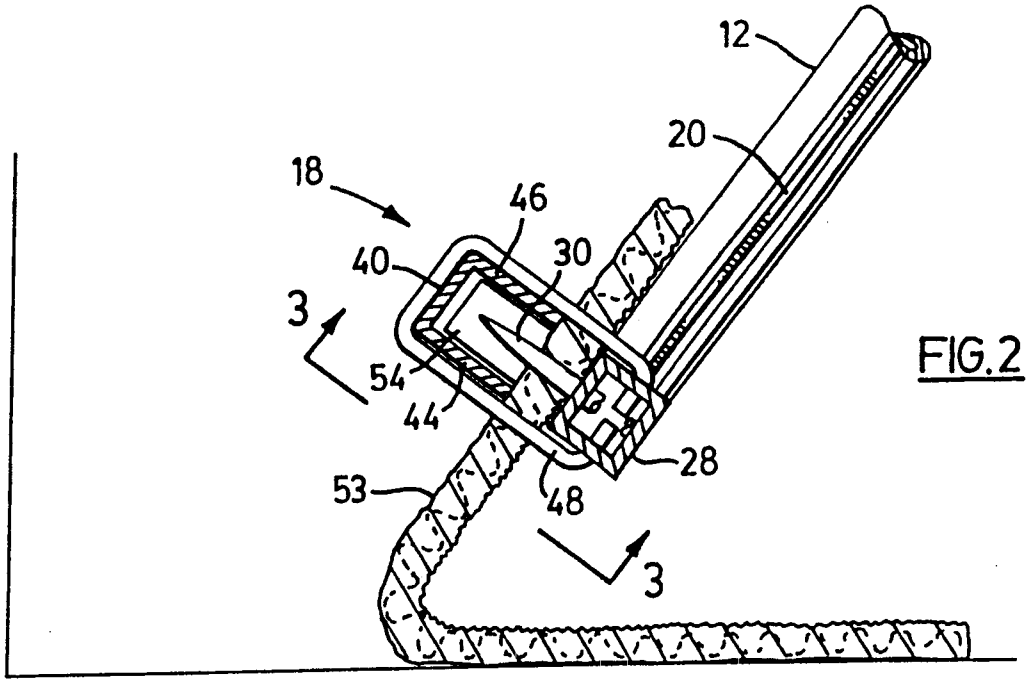
FIG. 2 is a partial sectional view taken along lines 2—2 of FIG. 1.
Figure 3:
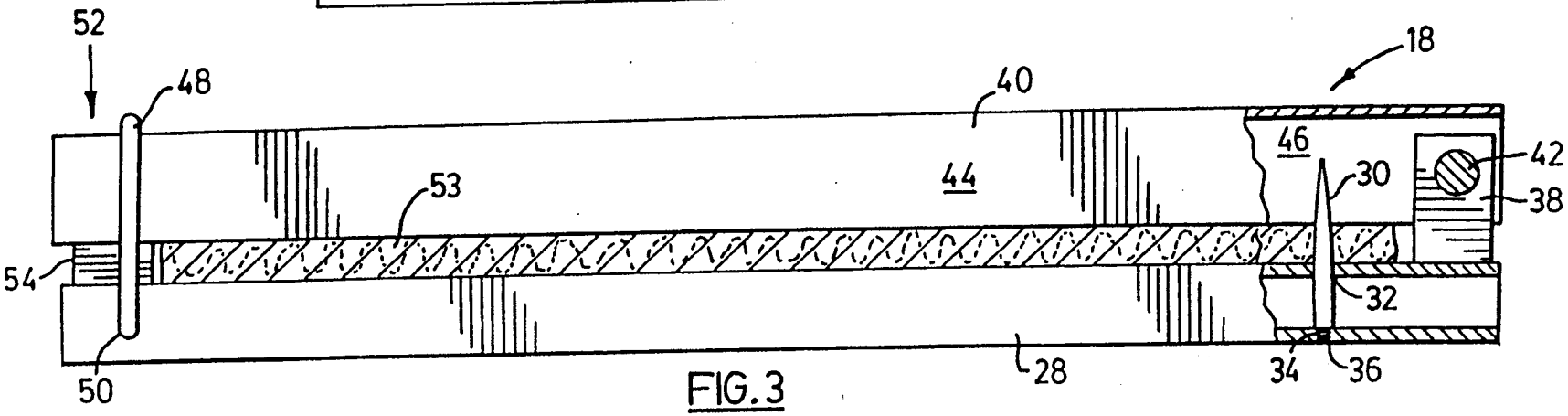
FIG. 3 is an end view of the carpet stripper taken along lines 3—3 of FIG. 2.
Figure 4:
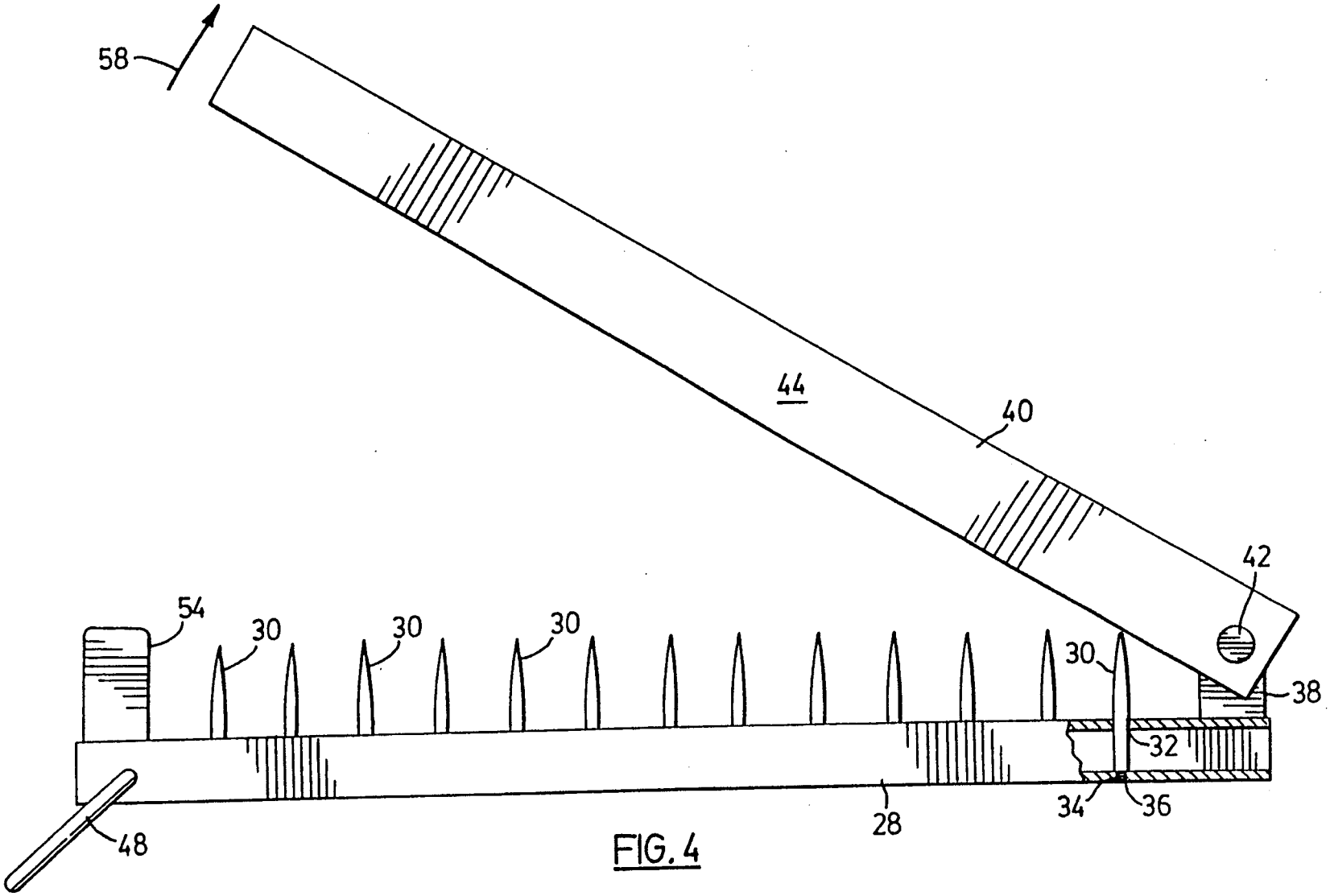
FIG. 4 is an end view, partly broken away, of the gripping assembly of the carpet stripper showing the jaws opening to receive a peripheral edge portion of a strip of carpet to be removed.

Referring in particular to FIGS. 2, 3 and 4, gripping assembly 18 has an elongate lower jaw 28 formed of square tubular stock, the length of which is between 20 and 65 centimeters, and preferably about 45 centimeters. The width of tubular lower jaw 28 is typically about 2.5 centimeters if steel tubing is used for lower jaw 28. Handle 12 and gussets 20 are attached to one side of lower jaw 28 as seen best in FIG. 2. A plurality of longitudinally spaced-apart spikes 30 extend upwardly from lower jaw 28. Spikes 30 pass through openings 32 in the top wall of lower jaw 28 and have threads 34 for threadably and removably mounting spikes 30 in corresponding threaded openings 36 in the lower wall of lower jaw 28. Spikes 30 are typically about 6 centimeters in length and 0.5 centimeters in diameter, and the longitudinal spacing between spikes 30 along jaw 28 is preferably between 2 and 2.5 centimeters. Spikes 30 are preferably formed of tempered steel.

A first end of lower jaw 28 has an upright post 38 rigidly attached thereto. An inverted, U-shaped upper jaw 40 is hingeably or pivotally mounted on upright post 38 by a pivot pin 42, so that upper jaw 40 can swing down over spikes 30 as indicated in FIGS. 2 and 3. Pivot pin 42 could be a rivet or a threaded fastener or a clevis pin as desired. The width of upright post 38 corresponds to the inside spacing between upright walls 44, 46 of upper jaw 40 to eliminate side-to-side movement of upper jaw 40 relative to lower jaw 28.

A releasable locking member in the form of ring 48 is pivotally mounted in suitable openings 50 in a second opposed end of lower jaw 28 remote from the end having pivot post 38. Ring 48 swings up over the adjacent end of upper jaw 40 to lock the upper jaw in position covering spikes 30 as indicated in FIGS. 2 and 3. Ring 48 is released by compressing or moving upper jaw 40 in the direction of arrow 52 to allow ring 48 to slip over the end of upper jaw 40. When in the locked position, ring 48 encircles the free end of upper jaw 40 and the carpet 53 being pulled up by stripper 10 acts as a spring to urge upper jaw 40 upwardly into engagement with ring 48 and prevent ring 48 from sliding off the end of upper jaw 40.

A fixed post 54 is mounted on the end of lower jaw 28 adjacent to ring 48, so that as upper jaw 40 swings down into the position shown in FIGS. 2 and 3 the longitudinal upright sides 44, 46 of upper jaw 40 straddle fixed post 54 and the row of spikes 30. The width of fixed post 54 is slightly less than the inside distance between upright sides 44, 46 of upper jaw 40 to prevent side-to-side movement of upper jaw 40.

If desired, ring 48 could be pivotally mounted in upper jaw 40 to swing down and encircle lower jaw 28, or some other type of locking mechanism could be used, such as a removable pin passing through the upright walls 44, 46 and fixed post 54, as will be appreciated by those skilled in the art.

In use, the adhesively attached carpet to be pulled up or removed by carpet stripper 10 is cut along spaced-apart, parallel lines 56 to form longitudinal strips 53, 55 and 57 of carpet. The width of these carpet strips is preferably slightly less than the distance between posts 38, 54. Typically this is between 15 and 60 centimeters so that a full width of carpet is clamped between lower and upper jaws 28, 40 as seen best in FIG. 3.

An initial peripheral edge portion of each carpet strip is then manually lifted or pulled up. Usually this is the transverse peripheral edge at each end of the carpet strips adjacent to a wall 60, as indicated in FIGS. 1 and 2. Locking ring 48 is then swung down and upper jaw 40 is swung up as indicated by arrow 58 in FIG. 4 and this free end of the carpet strip is pressed onto spikes 30 so that the row of spikes pierces the carpet along the full length of jaws 28, 40. Upper jaw 40 is then swung down to clamp the edge of the carpet between jaws 28, 40 and locking ring 48 is swung up over the end of upper jaw 40 to lock the jaws in place. The carpet is then removed by pulling on handle bar 22 to pull the carpet back over onto itself. Handle 12 can be rotated or swung from side-to-side to rotate jaws 28, 40 as the handle is pulled. In this way, the pulling forces on the carpet strip can be concentrated and controlled as desired as the carpet is pulled up. When the first strip of carpet 53 is pulled up or removed, the procedure is repeated to pull up successive strips 55, 57, etc. As each strip is removed from the floor, jaws 28, 40 are opened and the carpet strip removed therefrom making the jaws ready to accept another strip of carpet.

Having described preferred embodiments of the invention, it will be appreciated that various modifications may be made to the structures described. For example, lower jaw 28, handle 12 and handle bar 22 preferably are tubular, but these elements could be of solid construction. If they are tubular, either square or round tubing could be used. Preferably steel is used for the tubing, but other materials could be used as well, such as high strength aluminum or titanium. It is desirable to keep the carpet stripper as light in weight as possible, yet provide sufficient strength to prevent deformation in use.

upper jaw 40 has been described as being U-shaped, but this member could be tubular as well with appropriate openings formed in one wall to accommodate spikes 30.

From the above, it will be appreciated that the present invention is a very simple, yet effective device for removing adhesively attached carpet. The device provides a very firm, full width grip on the carpet to be removed and allows the pulling forces to be controlled or manipulated easily simply by rotating handle 12 while pulling forces are being exerted on handle bar 22.

It will be apparent to those skilled in the art that in light of the foregoing disclosure, many alterations and modifications are possible in the practise of this invention without departing from the spirit or scope thereof. Accordingly, the scope of the invention is to be construed in accordance with the substance defined in the following claims.

I claim:

1. A carpet stripper comprising:

an elongate, rigid handle having a distal end portion; a gripping assembly rigidly attached to the distal end portion and extending transversely on either side of the handle, the gripping assembly having an elongate lower jaw including a plurality of longitudinally spaced-apart spikes extending upwardly therefrom, an inverted, U-shaped upper jaw hingeably attached to a first end of the lower jaw to swing down over the spikes, and a releasable locking member connected between a second opposed end of the lower jaw and the upper jaw to lock the upper jaw in position covering the spikes.

2. A carpet stripper as claimed in claim 1 wherein the spikes are arranged in a row and wherein the U-shaped upper jaw has downwardly extending, spaced-apart longitudinal sides located to straddle the row of spikes.

3. A carpet stripper as claimed in claim 1 wherein the spikes are threadably attached to the lower jaw to be removable.

4. A carpet stripper as claimed in claim 2 wherein the spikes are threadably attached to the lower jaw to be removable.

5. A carpet stripper as claimed in claim 1 wherein the releasable locking member is a ring dimensioned to encircle the free end of one of the lower and upper jaws, the ring being pivotally mounted in the other of the lower and upper jaws to swing over said free end and prevent separation of the jaws.

6. A carpet stripper as claimed in claim 5 wherein the ring is pivotally mounted in the lower jaw.

7. A carpet stripper as claimed in claim 1 wherein the elongate handle distal end portion is a first distal end portion, and wherein the handle has a second distal end portion remote from the first distal end portion; and further comprising a transverse handle bar rigidly attached to the second distal end portion.

8. A carpet stripper as claimed in claim 7 wherein the handle bar extends transversely on either side of the handle.

9. A carpet stripper as claimed in claim 7 wherein the handle bar is spaced from the gripping assembly a distance between one and two meters.

10. A carpet stripper as claimed in claim 8 wherein the handle bar is spaced from the gripping assembly a distance between one and two meters.

* * * * *